United States Patent [19]

Kaga et al.

[11] Patent Number: 4,666,384

[45] Date of Patent: May 19, 1987

[54] ROOTS TYPE BLOWER WITH REDUCED GAPS BETWEEN THE ROTORS

[75] Inventors: Matasaburo Kaga, Nishio; Toshio Takeda, Nagoya, both of Japan

[73] Assignee: Aisin Seiki Kabushiki Kaisha, Kariya, Japan

[21] Appl. No.: 889,594

[22] Filed: Jul. 25, 1986

Related U.S. Application Data

[63] Continuation of Ser. No. 637,016, Aug. 2, 1984, abandoned.

[30] Foreign Application Priority Data

Sep. 30, 1983 [JP] Japan ..... 58-182540

[51] Int. Cl.[4] ..... F04C 18/18

[52] U.S. Cl. ..... 418/150; 418/206

[58] Field of Search ..... 418/150, 206; 29/156.4 R, 156.8 R

[56] References Cited

U.S. PATENT DOCUMENTS

| | | | |
|---|---|---|---|
| 3,275,225 | 9/1966 | Schultz | 418/150 |
| 3,371,856 | 3/1968 | Thelen et al. | 418/150 |
| 4,227,869 | 10/1980 | Eriksson | 418/206 |

*Primary Examiner*—John J. Vrablik

*Attorney, Agent, or Firm*—Burns, Doane, Swecker & Mathis

[57] ABSTRACT

A Roots type blower wherein a secondary gap distance for rotor is determined in accordance with a cross angle between a normal line at a point of the outer periphery of theoretical base curve of the rotor and a line extending through said point and the rotor center.

10 Claims, 12 Drawing Figures

(PRIOR ART)

(PRIOR ART)

$\varphi = 0°, 90°$
$\beta = 0°$ $$\left.\begin{aligned} x' &= x - \ell\sin\theta \\ y' &= y + \ell\cos\theta \end{aligned}\right\} \text{--(2)}$$

ROOTS TYPE BLOWER WITH REDUCED GAPS BETWEEN THE ROTORS

This application is a continuation of application Ser. No. 637,016, filed Aug. 2, 1984, abandoned.

FIELD OF THE INVENTION

The present invention relates to an improvement in Roots type blowers, more particularly to an improvement in the rotor thereof.

The Roots type blower are a non-contact type blowers which have generally been used as a compressor or a blower. The present invention is applicable to those as mentioned above, and particularly applicable to a supercharger having the same structure specifically used for internal combustion engines, e.g., diesel engines.

BACKGROUND

Definitions

The term "gap distance" (primary or secondary) herein used refers to the size reduction of the shape of one rotor and the term "ultimate gap distance" refers to the distance of the gap produced between two rotors.

The Roots type blower as shown in FIGS. 1 and 2 is a two-shaft type blower. The housing 1 has an inner space 2 which is peculiar to the Roots type blower and an intake port 3 and a discharge port 4 which are communicated with the inner space 2. Two shafts 5*a* and 5*b* are rotatably disposed in the inner space 2 of the housing 1 by support means such as bearings 6 and 6 so that a given spacing(gap) is provided between the shafts. The lower shaft 5*a* serves as an input shaft. The shafts 5*a* and 5*b* are rotated in the opposite directions by means of synchronizing gears 6*a* and 6*b* which are disposed outside the housing 1. Rotors 7*a* and 7*b* are secured to the shafts 5*a* and 5*b* so that they are in a phase difference of 90° each other. The rotors 7*a* and 7*b* are rotated in a spaced relationship with each other and with the inner wall of the housing 1 so that they will not be interfered with each other. Usually such a gap is provided by reducing the shape of the rotors 7*a* and 7*b* such as a combination of epicycloidal and hypocycloidal curves by a given gap distance.

When the rotors 7*a* and 7*b* are rotated as shown in the drawings the two shaft type blower intakes air from the intake port 3 and imparts kinematic energy to the air in rotational directions of the rotors 7*a* and 7*b* within the inner space 2 of the casing 1 then discharges the compressed air from the discharge port 4.

As described above the prederermined gap distance is necessary for the rotors to avoid interfering with each other. The gap distance may be classified into the primary- and the secondary gap distance. The primary gap distance is necessary to provide a minimum gap distance between rotors for allowing them to rotate in a non-contact state. The secondary gap distance is necessary to prevent the interference with the adjacent rotor and the casing which occurs otherwise due to the tolerance is working and assembling of the parts such as rotors and the casing. It is the phase tolerance between the rotors that gives the greatest influence upon the determination of the secondary gap distance. This phase tolerance takes place mainly due to the assembly tolerance between the rotor and the shaft and meshing tolerance between synchronizing gears (including the assembling tolerance between the gear and the shaft). It is possible to somewhat reduce the phase tolerance by improving the precision of working and assembling the rotors and the synchronizing gears. The secondary gap distance is determined in anticipation to a possible maximum phase tolerance which is taken into consideration in the present state of the art.

In a conventional Roots type blower, the primary and the secondary gap distances have generally been provided by reducing the size of roots into a similar figure or equally reducing them in a direction normal to a corrected curve of the rotors. Such manners of determination of the gap distance will result in a resultant ultimate gap having a mean width at least as double as the designed gap distance. The mean width of the resultant clearance results in remarkably lowering the volume efficiency of the Roots type blowers.

SUMMARY OF THE INVENTION

It is an object of the present invention to provide a novel Roots type blower which is free of the aforementioned disadvantage.

It is another object of the present invention to provide a Roots type blower having an improved efficiency of the Roots type blower.

The objects of the present invention are accomplished by determining the second gap distance in accordance with the cross angle between a line normal to the theoretical base curve of the outer periphery of the rotor at a point thereon and a line connecting said point with the center of the rotor. The secondary gap distance for the rotor is determined in accordance with the cross angle, that is, in porportion thereto or by multiplying the cross angle with a variable parameter since the larger cross angle involves the greater interference with the adjacent rotor under the pressure of even a slight phase tolerance in a operation range of the rotors. By doing so the mean ultimate gap between the rotors becomes as about a half narrower as that of the conventional one. As a result, the efficiency of the Roots type blower is significantly improved as compared with conventional one.

The theoretical base curve of the rotors may be based on an original theoretical curve which is a combination of an epicycloidal and hypocycloidal curves, or a first corrected curve which is determined by reducing the primary gap distance from the original theoretical curve.

It is preferable that the secondary gap distance be determined upon the basis of a function which varies as the cross angle varies. Thus, the function may be a function obtained by rotating a point on the outer periphery of the theoretical base curve by a very small angle $\delta$ about the center of the rotor or a sinusoidal function having a variable which is, e.g., a half of the angle between the line extending from the rotor center to the point of the theoretical base curve and the minor axis of the rotor. In those cases, theoretical base curve may be a first corrected curve which is equally reduced in a direction normal to the original theoretical curve. The former case is advantageous when the contour of the rotor is machined by means of numerically controlled machine tool, i.e., a computer-controlled machine. The latter case is convenient since the secondary gap distance may be added to the primary gap distance when the secondary gap distance is taken in a direction normal to the theoretical base curve. The present invention is not only applicable to the cycloidal rotor as mentioned above, but also involute and envelope type rotors. The present invention is also applicable to three-labeled rotor type blowers as well as two-labeled rotor blowers.

DETAILED DESCRIPTION OF THE PREFERRED EMBODIMENTS

The present invention will be described by way of various embodiments with reference to the drawings.

Figure 1:
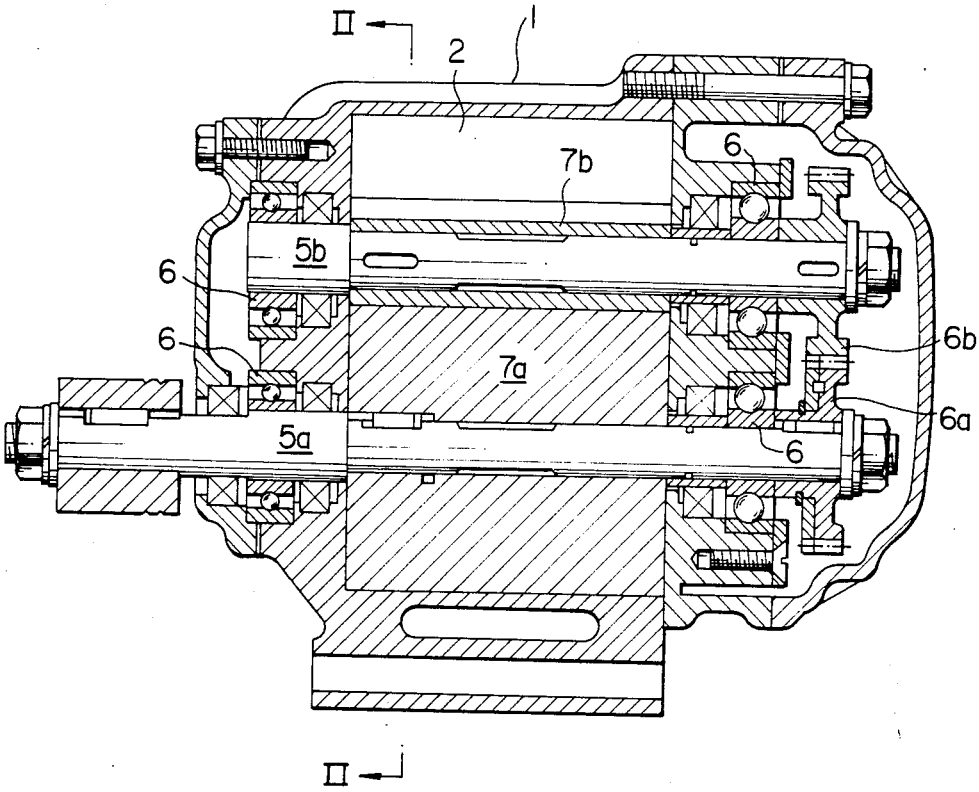
FIG. 1 is a sectional view showing a conventional Roots type blower.
Figure 2:
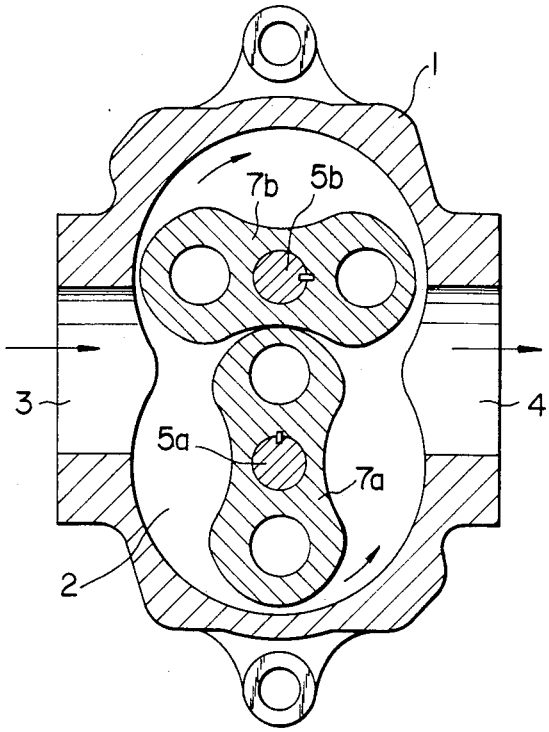
FIG. 2 is a sectional view along the line I—I of the FIG. 1.
Figure 3:
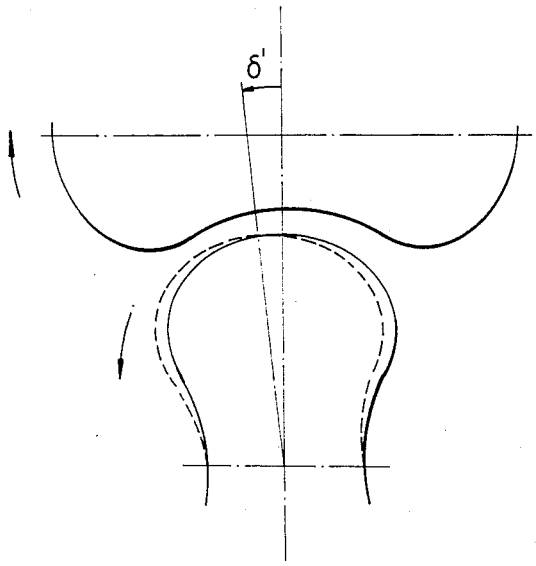
FIGS. 3 and 4 are explanatory views illustrating the phase tolerance between the rotors.
Figure 4:
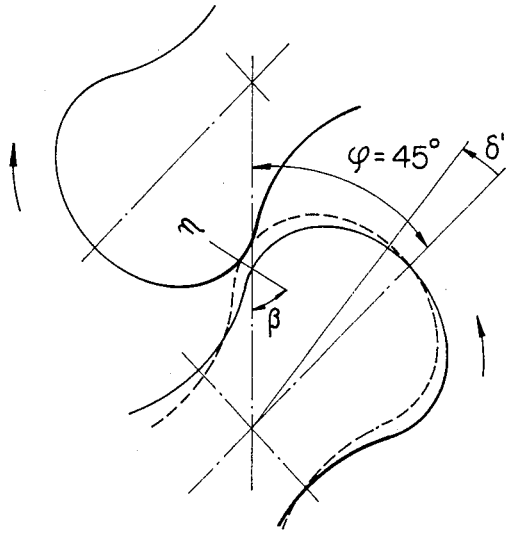

Referring now to FIG. 3, the cross angle $\beta$ between the normal line n at a point on the outer periphery of a rotor and a line extending from the point to the rotor center is 0° when the angle $\psi$ between the center lines of both two leave rotors and the major or minor axis of the rotor is 0° or 90°. At $\psi=0°$ or 90°, both rotors come within close proximity of each other even when there is a phase tolerance $\delta'$ and one rotor is disposed at a position designated by the chain line. In contrast to this position, the cross angle $\beta$ reaches a maximum value and the rotors come within closer proximity of each other than above at the same phase tolerance $\delta'$ when $\psi$ is 45° as shown in FIG. 4. The present invention determines the secondary gap distance upon the basis of the above-mentioned fact. Accordingly in the most preferred embodiment the secondary gap distance is determined by rotating a point on the theoretical base curve, which is the first corrected curve of the rotor, by a very small angle $\delta$ about the rotor center. In this case it is preferable tha the very small angle $\delta$ be equal to the phase tolerance. The angle $\delta$ is preferably 0.05°–0.5°, and most preferably about 0.1°.

Now the case in which the primary gap distance is determined as a given amount l by which the original theoretical curve defining the cycloidal shape of the rotor is reduced to a first corrected curve as the theoretical base curve will be described.

Figure 5:
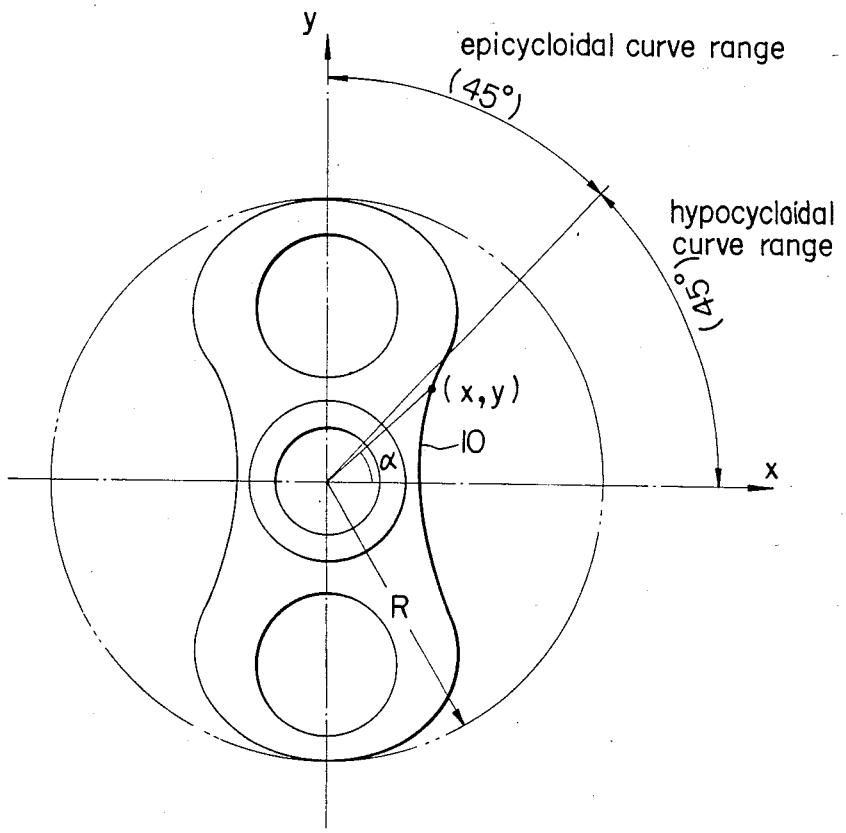
FIGS. 5 to 7 are schematic views showing an embodiment of the present invention.

FIG. 5 shows an original theoretical curve 10 of a two-lobed rotor. The curve in the first quadrant includes a hypocycloidal curve from the minor axis to 45° and an epicycloidal curve from 45° to the major axis. In the drawing the minor axis is abscissa(x) axis and major axis is ordinate (y) axis.

Figure 11:
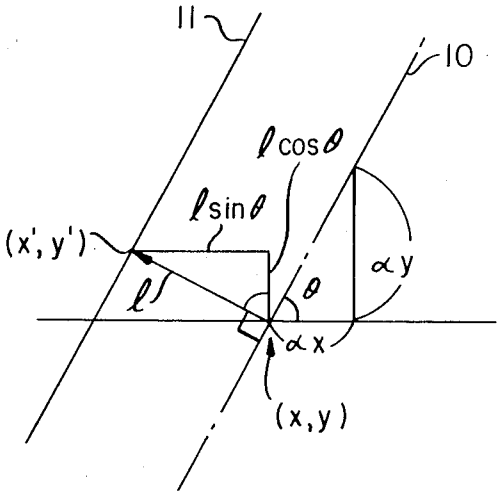
FIG. 11 is a graphical representation of the embodiment of FIGS. 5 to 7.

The hypocycloidal curve defining a rotor is represented by the following formulae;

$$\left.\begin{aligned} x &= (\tfrac{3}{4})R\cos\alpha - (\tfrac{1}{4})R\cos 3\alpha \\ y &= (\tfrac{3}{4})R\sin\alpha + (\tfrac{1}{4})R\sin 3\alpha \end{aligned}\right\} \quad (1)$$

wherein R is the radius of the major axis of the rotor and $0 \leqq \alpha \leqq \pi/4$. Thereon dy/dx is expressed by the formulae:

$$dy/dx = (\cos\alpha + \cos 3\alpha)/(-\sin\alpha + \sin 3\alpha)$$

resulting in $\theta = \tan^{-1}(dy/dx)$ wherein $-\pi/2 \leqq \theta \leqq \pi/2$, provided that $\theta = \theta + \pi$ when $\theta < 0$. The relationship of $(\theta)$ to dy/dx is depicted in FIG. 11.

A first corrected curve 11 is formed by reducing (or contracting) the original theoretical curve 10 by a primary gap distance, i.e., a given amount l in the normal direction. A point $(x_1, y_1)$ on the first corrected curve 11 is expressed by the following formulae (refer to FIG. 6).

$$\left.\begin{aligned} x_1 &= x - l\sin\theta \\ y_1 &= y + l\cos\theta \end{aligned}\right\} \quad (2)$$

Figure 7:
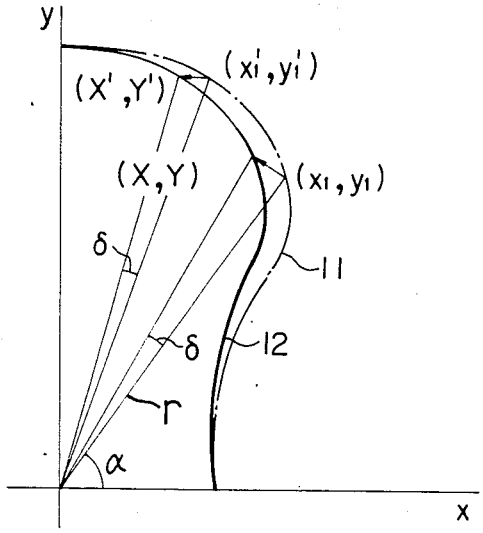

The point (X,Y) on the outer periphery of the finish shape of the rotor, in which the secondary gap distance has been reduced from the formulae (2) is obtained by rotating the formulae (2) by a very small angle $\delta$ toward the major axis about the rotor center (refer to FIG. 7).

$$x_1 = r\cos\alpha$$

$$y_1 = r\sin\alpha$$

$$X = r\cos(\alpha+\delta)$$

$$Y = r\sin(\alpha+\delta)$$

$$X = r(\cos\alpha\cos\delta - \sin\alpha\sin\delta)$$

$$X = (r\cos\alpha)\cos\delta - (r\sin\alpha)\sin\delta$$

$$X = x_1\cos\delta - y_1\sin\delta$$

$$Y = r(\sin\alpha\cos\delta + \cos\alpha\sin\delta)$$

$$Y = (r\sin\alpha)\cos\delta + (r\cos\alpha)\sin\delta$$

$$Y = x_1\sin\delta + y_1\cos\delta$$

$$\left.\begin{aligned} X &= x_1\cos\delta - y_1\sin\delta \\ Y &= x_1\sin\delta + y_1\cos\delta \end{aligned}\right\} \quad (3)$$

The epicycloidal curve defining the other part of the rotor is expressed by the following formulae.

$$\left.\begin{aligned} x &= (5/4)R\cos\alpha - (1/4)R\cos(5\alpha - \pi) \\ y &= (5/4)R\sin\alpha - (1/4)R\sin(5\alpha - \pi) \end{aligned}\right\} \quad (4)$$

where $\pi/4 \leqq \alpha \leqq \pi/2$.

The following formulae is thus established.

$$dy/dx = \{\cos\alpha - \cos(5\alpha - \pi)\}\{-\sin\alpha + \sin(5x - \pi)\}$$

Accordingly $\theta = \tan^{-1}(dy/dx)$ where $-\pi/2 \leqq \theta \leqq \pi/2$ provided:

$\theta=\theta+\pi$ when $\theta<0$.

Figure 6:
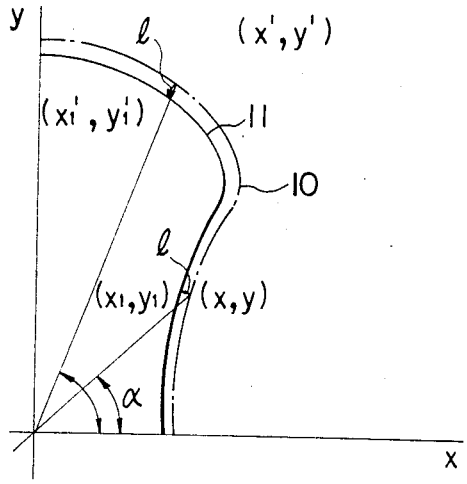

A point $(x_1,y_1)$ on the first corrected curve which is formed from the original theoretical curve expressed by the formulae (4) is expressed as follows (refer to FIG. 6).

$$\left.\begin{aligned} x_1 &= x - l\sin\theta \\ y_1 &= y + l\cos\theta \end{aligned}\right\} \quad (5)$$

A point $(x_1,y_1)$ on the outer periphery of the rotor finsih shape, in which the secondary gap distance is reduced form the formula (5) is obtained by rotating the point $(x_1,y_1)$ counterclockwise by a very small angle $\delta$ about the original of coordinates and is expressed as follows (refer to FIG. 7);

$$\left.\begin{aligned} X &= x_1\cos\delta - y_1\sin\delta \\ Y &= x_1\sin\delta + y_1\cos\delta \end{aligned}\right\} \quad (6)$$

The trace 12 of X,Y which are expressed by the formulae (3) and (6) becomes a finish shape of the rotor. For example the primary gap distance may be 0.05 mm and the secondary gap distance which is a very small angle $\delta$ may be 0.21 ($\pi/180$) when the radius R of the major axis of the rotor is 30 mm. Substitution of these values for the formulae (3) and (6) and changing $\alpha$ over a range $0\leqq\alpha\leqq\pi/2$ makes a finish curve for the original theoretical curve of the rotor, that is, a curve obtained by reducing the given gap distances from the original theoretical curve.

Figure 8:
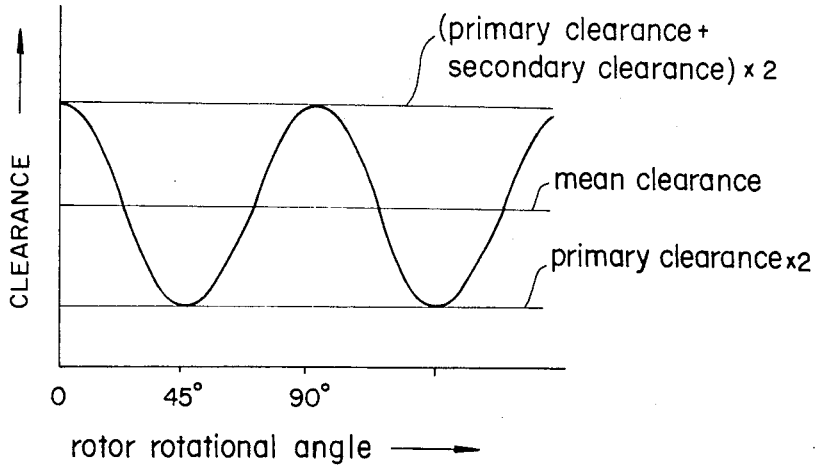
FIG. 8 is a graph showing the relation between the rotation angle of the rotor and the gap between the rotors.

The relation between the rotation angle of the rotor and the gap width between the rotors is shown in FIG. 8. It is apparent from the drawing that the gap width between the rotors in the present embodiment varies like a sinusoidal wave between a value of the primary gap distance×2 and a value of (the primary plus the secondary gap distances)×2 which is equal to the conventional mean gap width. Therefore the mean gap width between the rotors in the present embodiment is equal to the primary offset×2 plus the secondary gap distance. It is apparent that the efficiency of the Roots type blower is significantly improved in accordance with the present invention. Furthermore the mean gap distance of the present invention is lower than that of the conventional blowers even if there is a phase tolerance.

Figure 9:
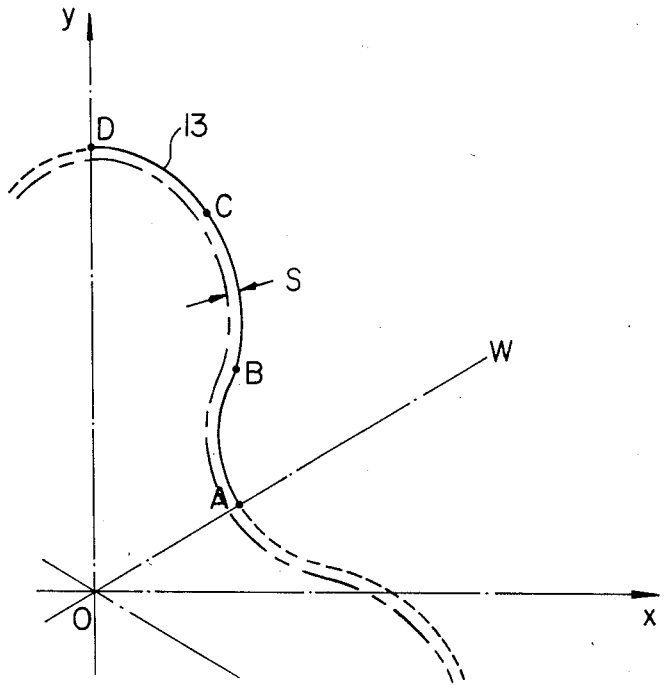
FIG. 9 is an explanatory view showing another embodiment of the present invention.

FIG. 9 shows another embodiment of the present invention in which a rotor has three lobes. The original theoretical curve 13 of the shown rotor includes a circular arc between points A and B, an involute curve between points B and C and a circular arc between points C and D. The finish shape of the rotor is formed by reducing the original theoretical curve by S in a normal direction to form a first corrected curve and by rotating the first corrected curve counterclockwise by a very small angle $\delta$ about the rotor center.

Figure 12:
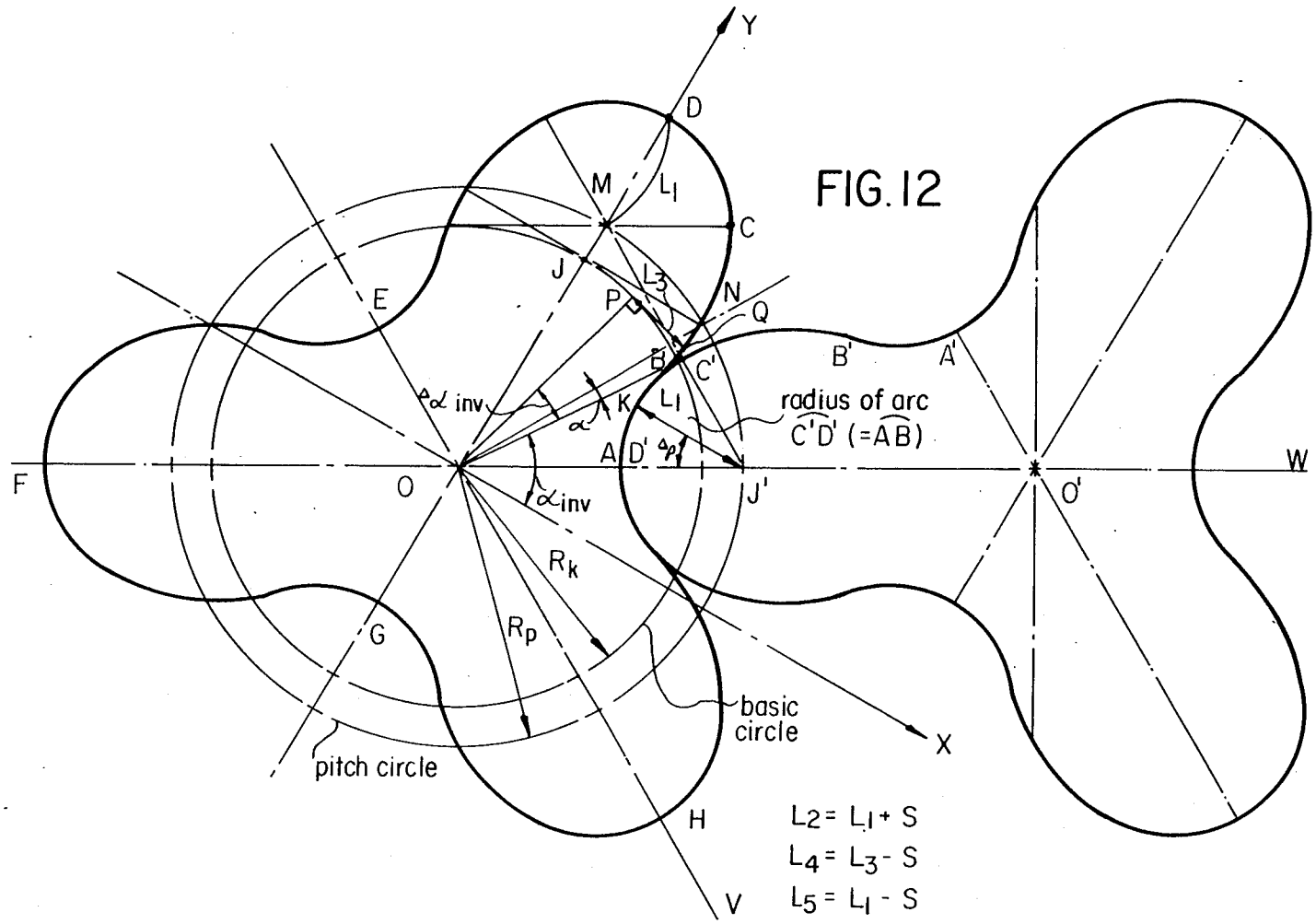
FIG. 12 is a further explanatory view of the embodiment of FIG. 9.

With reference to FIG. 12, fundamental formula of the three-lobed type rotor is expressed as follows:

$$R_K = (\sqrt{3}/2)\cdot R_P$$

where $R_p$ is the radius of a pitch circle and $R_k$ is the radius of basic circle.

(1) Portion AB of the circular arc:

The length of the original theoretical curve $L_1=(1/6)\cdot\pi R_k$ and the length of the first corrected curve $L_2=L_1+S$.

Accordingly the coordinate position $(x_1, y_1)$ of the first corrected curve is expressed as follows:

$$x_1=R_p\cos(\pi/6)-L_2\cos(-\pi/6+\Delta\beta)$$

$$y_1=R_p\sin(\pi/6)+L_2\sin(-\pi/6+\Delta\beta)$$

where $\Delta\beta$ is in a range of $0\leqq\Delta\beta\leqq\pi/3$.

The coordinate position $(x_1,y_1)$ is rotated counterclockwise by a small angle $\delta$ so that the following formulae are provided:

$$X=x_1\cos\delta-y_1\sin\delta$$

$$Y=x_1\sin\delta+Y_1\cos\delta$$

(2) Portion BC of the involute curve:

The length of the involute curve $L_3=R_k\Delta\alpha_{inv}$ and the length of the first corrected curve $L_4=L_3-S$ wherein pressure angle $\alpha_{inv}=(\frac{1}{2})(\pi-R_p/R_k)$ and an angle range $\gamma=\pi/3-\alpha_{inv}$ provided: $\gamma\leqq\Delta\alpha_{inv}\leqq\pi/3+\gamma)$.

The coordinate position $(x_1,y_1)$ of the first corrected curve is expressed as follows:

$$X=R_k\cos(\alpha_{inv}+\Delta\alpha_{inv})+L_4\sin(\alpha_{inv}+\Delta\alpha_{inv})$$

$$Y=R_k\sin(\alpha_{inv}+\Delta\alpha_{inv})-L_4\cos(\alpha_{inv}+\Delta\alpha_{inv})$$

Accordingly, the coordinate position $\{X(x_1,y_1), Y(x_1,y_1)\}$ obtained by rotating the position $(x_1,y_1)$ by a very small angle $\delta$ is expressed as follows:

$$X=x_1\cos\delta-y_1\sin\delta$$

$$Y=x_1\sin\delta+y_1\cos\delta$$

(3) Portion CD of the circular arc:

The length of the original theoretical curve $L_1$ is $(1/6)\cdot\pi R_k$ and the length of the first corrected curve $L_5$ is $(L_1-S)$.

Accordingly the coordinate position $(x_1,y_1)$ of the first corrected curve is expressed as follows:

$$x_1=L_5\cos(\pi/6+\Delta\gamma)$$

$$y_1=R_p+L_5\sin(\pi/6+\Delta\gamma)$$

where $0\leqq\Delta\gamma=\pi/3$.

Therefore the coordinate position $(X(x_1,y_1),Y(x_1,y_1))$ obtained by the rotation of a very small angle is expressed as follows;

$$X=x_1\cos\delta-y_1\sin\delta$$

$$Y=x_1\sin\delta+y_1\cos\delta$$

Substitution of 25 mm for $R_p$, 0.05 mm for S and $0.21(\pi/180)$ for $\delta$ determines the coordinate position of the finish shape for the original theoretical curve of the three lobed type rotor.

Figure 10:
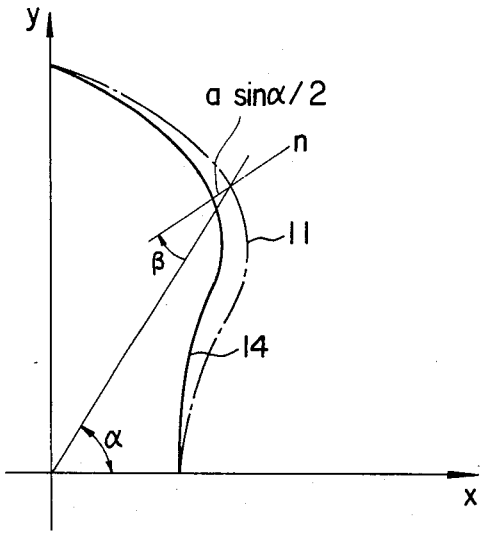
FIG. 10 is a partial view showing another embodiment of the present invention.

Alternatively a first corrected curve 11 is formed as shown in FIG. 10 by reducing the original theoretical curve by a primary gap distance, that is, a given amount l in a normal direction and a secondary gap distance amount a·sin $\alpha/2$ (where a is a given constant) is taken from the curve 11 as the theoretical base curve resulting in the actual rotor curve 14.

What is claimed is:

1. A Roots type blower of the type comprising intermeshing rotor means including a rotor whose shape constitutes a reduction from an original theoretical base shape, said reduction comprising a combination of primary and secondary reductions, said primary reduction being uniform around the rotor periphery, said secondary reduction being variable along an outer periphery of said rotor in accordance with a cross-angle defined by the intersection of a first line extending normal to a point on said periphery and a second line extending to said point from an axis of rotation of said rotor, such that the secondary reduction is smallest at locations where said cross-angle is zero and becomes larger between said locations.

2. The Roots type blower as set forth in claim 1 characterized by that the secondary reduction distance is determined by a function which varies as the cross angle varies.

3. The Roots type blower as set forth in claim 2 characterized by that said function is a function which rotates the point on the outer periphery of said theoretical base curve by a very small angle $\delta$ about the rotor center.

4. The Roots type blower as set forth in claim 2 characterized by that said function is a sinusoidal function a $\sin \gamma/2$ where $\gamma$ is the angle between said line and the rotor minor axis.

5. The Roots type blower as set forth in claim 3 characterized by that the small angle $\delta$ is determined within predetermined values in accordance with an intersecting angle of the line extending through said point and the rotor center with one of axes of the rotor.

6. The Roots type blower as set forth in claim 3, characterized by that the small angle $\delta$ is constant.

7. The Roots type blower as set forth in claim 4, characterized by that the parameter a is selected within a range of predetermined values.

8. The Roots type blower as set forth in claim 4 characterized by that the parameter a is constant.

9. The Roots type blower as set forth in claim 1, characterized by that said theoretical base curve is a curve defined by a combination of epicyloidal and hypocycloidal curves.

10. The Roots type blower as set forth in claim 1, characterized by that said theoretical base curve is a first corrected curve defined by reducing the primary gap distance from a curve defined by a combination of epicycloidal and hypocycloidal curves, the primary gap distance being defined as the minimum size reduction of a rotor so as to allow the rotors to rotate in a non-contacting state.

* * * * *